US005427451A

United States Patent [19]

Schmidt

[11] Patent Number: 5,427,451

[45] Date of Patent: Jun. 27, 1995

[54] MIXER WITH AN OSCILLATING DRIVE

[75] Inventor: Günther Schmidt, Kleve, Germany

[73] Assignee: Kuston (Deutschland) GmbH, Kleve, Germany

[21] Appl. No.: 246,608

[22] Filed: May 20, 1994

[30] Foreign Application Priority Data

May 22, 1993 [DE] Germany ..... 9307761 U

[51] Int. Cl.[6] ..... B01F 11/00

[52] U.S. Cl. ..... 366/208; 366/111; 366/127

[58] Field of Search ..... 366/173, 274, 108, 208, 366/209, 215, 216, 218, 219, 110, 111, 116, 127, 600, 601; 68/355

[56] References Cited

U.S. PATENT DOCUMENTS

| | | | |
|---|---|---|---|
| 3,601,372 | 8/1971 | Harmes | 366/219 |
| 4,061,315 | 12/1977 | Eitzen | 366/111 |
| 4,870,982 | 10/1989 | Liu | 366/127 |
| 5,060,151 | 10/1991 | Mikyska | 366/208 |

*Primary Examiner*—Robert W. Jenkins
*Attorney, Agent, or Firm*—Herbert Dubno

[57] ABSTRACT

A multidimensional oscillation of an object carrier upon which a vessel containing a medium to be mixed can be placed, can have a X frame suspended by a pair of X leaf springs on a base plate and supporting a Y frame having leaf springs extending upwardly from the X frame and connected at the top of the Y springs by the X frame plate. The X frame can be mounted upon the Z frame oscillating in the Z direction and all oscillations can be induced by oscillating drives consisting of permanent magnets juxtaposed with exciting coils adjustable as to frequency, amplitude and phase.

14 Claims, 4 Drawing Sheets

MIXER WITH AN OSCILLATING DRIVE

FIELD OF THE INVENTION

The present invention relates to a mixer with an oscillating drive and, more particularly, to a mixing assembly in which an object carrier is subjected to oscillation to effect mixing of the contents of that carrier.

BACKGROUND OF THE INVENTION

Mixers are provided with a variety of configurations. Some mixers, for example, have stirrers which adversely affect the microstructure of the medium to be agitated, especially by a shear action and have been found not be useful for some kinds of biological system where cell disruption is a drawback. For mixing in systems in which tissue or cell damage may occur or mixing blades may disrupt biological materials or have an adverse effect on the mixture, it is known to provide an oscillating drive for the vessel which may be a shaker vessel or the like and which can impart an oscillatory movement to the object carrier or vessel. The oscillatory movement can be a linear movement or a rotary movement. These mixers generally operate with frequencies up to 20 Hz. Ultrasonic mixers have been provided heretofore as well and these generally operate at frequencies of 20 kHz or higher.

OBJECTS OF THE INVENTION

It is the principal object of the present invention to provide a mixer which can operate with minimal damage to biological material and which avoids the drawbacks of stirrer-type mixers, which can impart a multidimensional oscillation to the object carrier or vessel and which can operate at frequencies up to 20 kHz as may be required in many cases.

Another object of this invention is to provide an oscillatory mixer in which the object carrier is set into multidimensional oscillation and which can avoid drawbacks of earlier mixers.

SUMMARY OF THE INVENTION

These objects and others which will become apparent hereinafter are attained by providing the object carrier on a horizontal Y-frame movable in the Y direction and supported for oscillatory movement in the Y direction via at least one Y spring deflectable in this direction upon a horizontal X-frame movable in the X direction and suspended by at least one X spring deflectable in the X direction, the X-frame being suspended from a base plate and the Y-frame and X-frame being excited by respective oscillating drives comprised of permanent magnets and juxtaposed drive coils.

A mixer of this type has been found to be advantageous in use in a variety of laboratories for different mixing purposes and, indeed, wherever damage to biological tissue is to be avoided. Since the oscillating drives operate in accordance with the principle of a direct current linear motor and respectively generate movement in only one direction which can be controlled as to frequency and amplitude with the combination of drives imparting the multidimensional motion to the object carrier through the Y-frame and the X-frame, the operating parameters of the mixer can be adjusted to suit approximately any requirement without difficulty More particularly, the mixer for multidimensional oscillation of an object can comprise:

a first generally horizontal frame movable in a Y-axis direction and carrying the object;

first spring means including at least one spring deflectable in the Y-axis direction for supporting the first frame for oscillation in the Y-axis direction;

a second generally horizontal frame movable in a X-axis direction supporting the first spring means and the first frame thereon;

second spring means including at least one spring deflectable in the X-axis direction for supporting the second frame for oscillation in the X-axis direction;

a base plate supporting the second spring means; and respective oscillating drives for the frames each including a permanent magnet and a drive coil juxtaposed with the respective permanent magnet and operatively connected to the frames for oscillatingly driving the first frame in the Y-axis direction and the second frame in the X-axis direction.

Preferably the Y springs and the X springs are leaf springs. The Y frame and X frame each can be of rectangular, e.g. square, outline and can be engaged by respective pairs of leaf springs at opposite edges of the rectangular frame. Apart from spring losses, the mounting of the movable parts is practically friction-free. The springs can be so disposed that they are attracted by the permanent magnet flux of the respective oscillating drive without thereby adversely affecting the desired direction-dependent spring deflection.

The mixer of the invention can also set the object carrier into three-dimensional oscillatory movements when in combination with the foregoing structure, the X frame is supported by at least one Z spring deflectable in the Z direction and which is affixed to a frame movable in the Z direction, the Z frame having at least one oscillating drive associated therewith. To stabilize the object carrier it can be advantageous to mount the Z carrier so that it is deflectable via hinges having hinge axes extending in the X direction, the deflection direction being in the Z direction. The hinges can have spring plates deflectable in the Y direction connected to the Z frame.

In a preferred embodiment of the invention, at least one device is provided for altering a spring constant of one of the springs. The device can be provided for two dimensional modifications of the spring constants of a spring rod engaged at one end and carrying a mass adjustable along the spring rod. The adjustment means can be a device for monodimensional modification of the spring constant of a spring bar braced at one side or a leaf spring braced at one side and straddled by the arms of a fork which is adjustable parallel to the rod or leaf spring by an appropriate drive such as a spindle drive.

Precise setting of the resonance of the apparatus by changing of the spring constants ensures for different movable masses of the medium in the object carrier, operation within an optimum range according to a feature of the invention, a device for the monodimensional adjustment of the spring constant of at least one X spring engaging the X frame or the Y frame and the base plate, a device is provided to alter the spring constants whereby the spring rod or a part connected therewith is clamped on the spring plate and is engaged in a journal bearing of the frame.

An adjustment of the resonance point in the Z direction is possible when, between the Z frame and a base plate, a device is provided for altering the spring constant which can include a horizontally-extending spring rod on the base plate or on a part connected therewith and which extends into a journal bearing of the Z frame.

The oscillating drives should be adjustable independently from one another as to frequency, amplitude and phase and the control or regulation can use feedback control if desired so that the direction-dependent oscillation in each case is optimal.

It has been found to be advantageous, further, to provide means for detecting and monitoring the operating parameters of the oscillating drives as a function of time to allow the mixer to be used also for other purposes as, for example, for viscosity determinations of the medium subject to mixing. For this purpose measurement loops or the like can be incorporated in the coils of the oscillating drive and control or regulatory circuitry can be fed by such loops. As a consequence, viscosities which change with mixing can be monitored and the change of the moment of inertia associated with viscosity changes can be utilized to shift the resonance point or to detect shift in the resonance point. The shift can be utilized to automatically allow the drives to operate at a new resonance point for optimum mixing or can allow change in the resonance point to act as a measurement of the viscosity.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
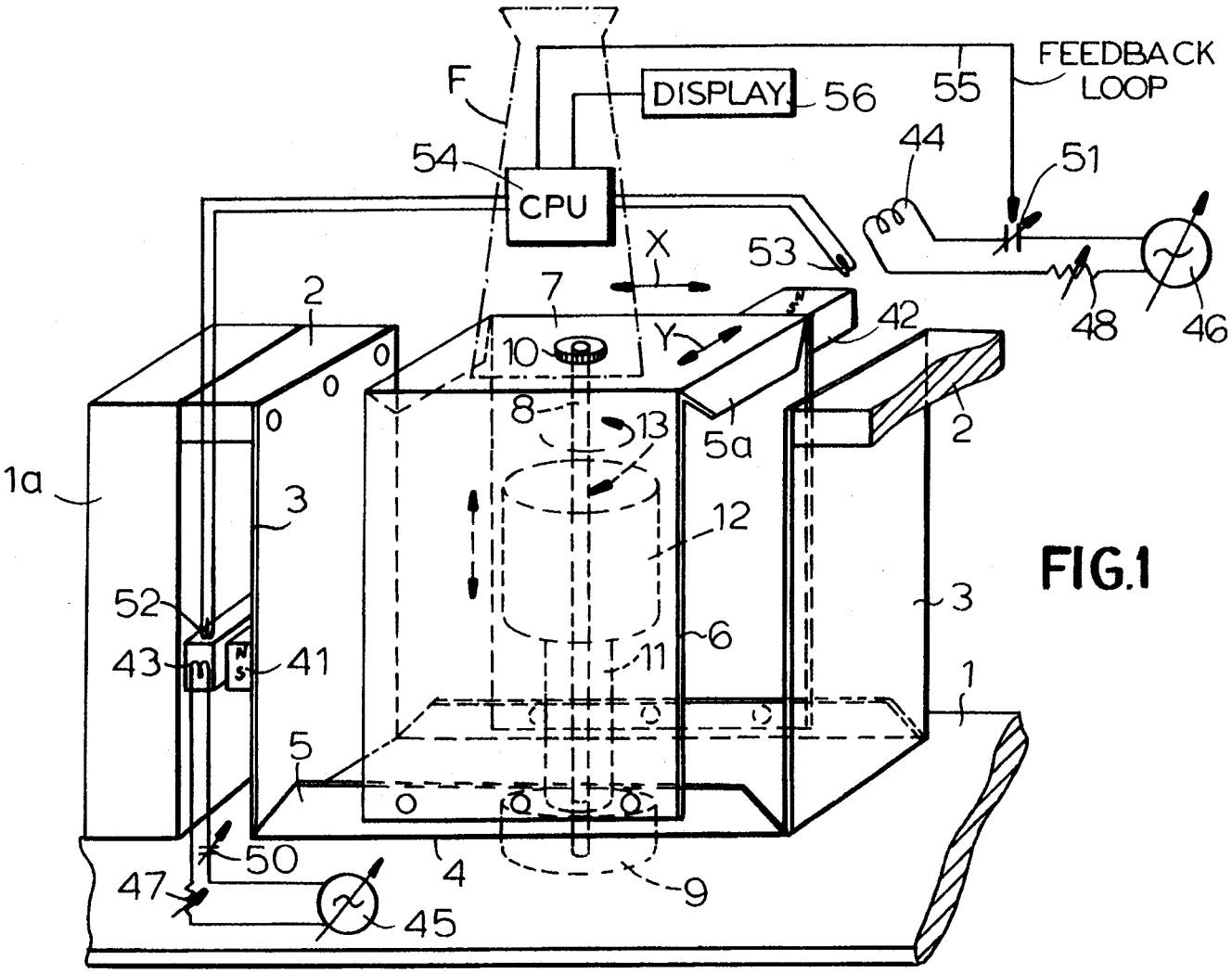
FIG. 1 is a highly diagrammatic perspective view, partly broken away, of a mixer for two-dimensional oscillatory mixing.

The mixer shown in FIG. 1 has a rigid base plate 1 which can be formed with rigid posts 1*a* to which two opposing attaching angles 2 are secured, the attaching angles 2 being formed with vertically downwardly-extending leaf springs 3 deflectable in the X direction and constituting the X springs previously mentioned. These springs are parallel to one another and, at their bottom ends, support the plate 4 of a X frame with stiffening formations 5 along opposite longitudinal edges of this plate. The stiffening formations 5 may be upwardly-turned flanges.

To the upwardly-turned flanges 5, there are affixed a pair of leaf springs 6 also mutually parallel and generally vertically extending and deflectable in the Y direction so as to constitute the Y springs previously mentioned. At their upper ends, the Y springs 6 are affixed to a plate 7 forming a rectangular Y frame with lateral edges stiffening at 5*a*, i.e. downwardly-turned flanges.

Upon the Y frame plate 7, an object carrier is mounted. The object carrier has not been shown except as a flask F in dot-dash lines in FIG. 1. In general, any carrier for a medium to be mixed may be provided on the Y frame plate 7.

On the X frame plate 4 and on the Y frame plate 7, respective oscillatory drives act which include permanent magnets and drive coils juxtaposed therewith.

Figure 2:
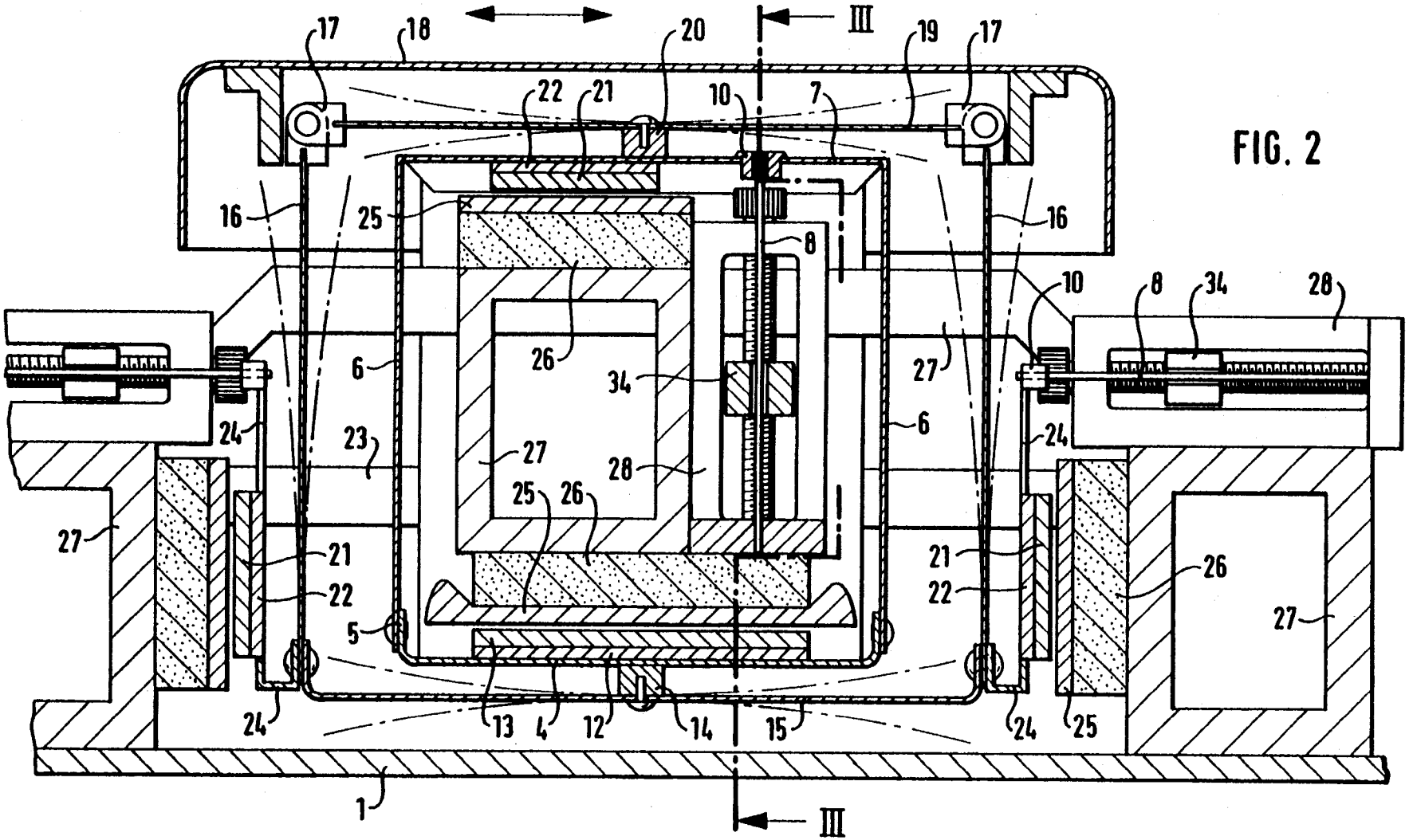
FIG. 2 is a vertical section through a mixer for three-dimensional mixing.
Figure 3:
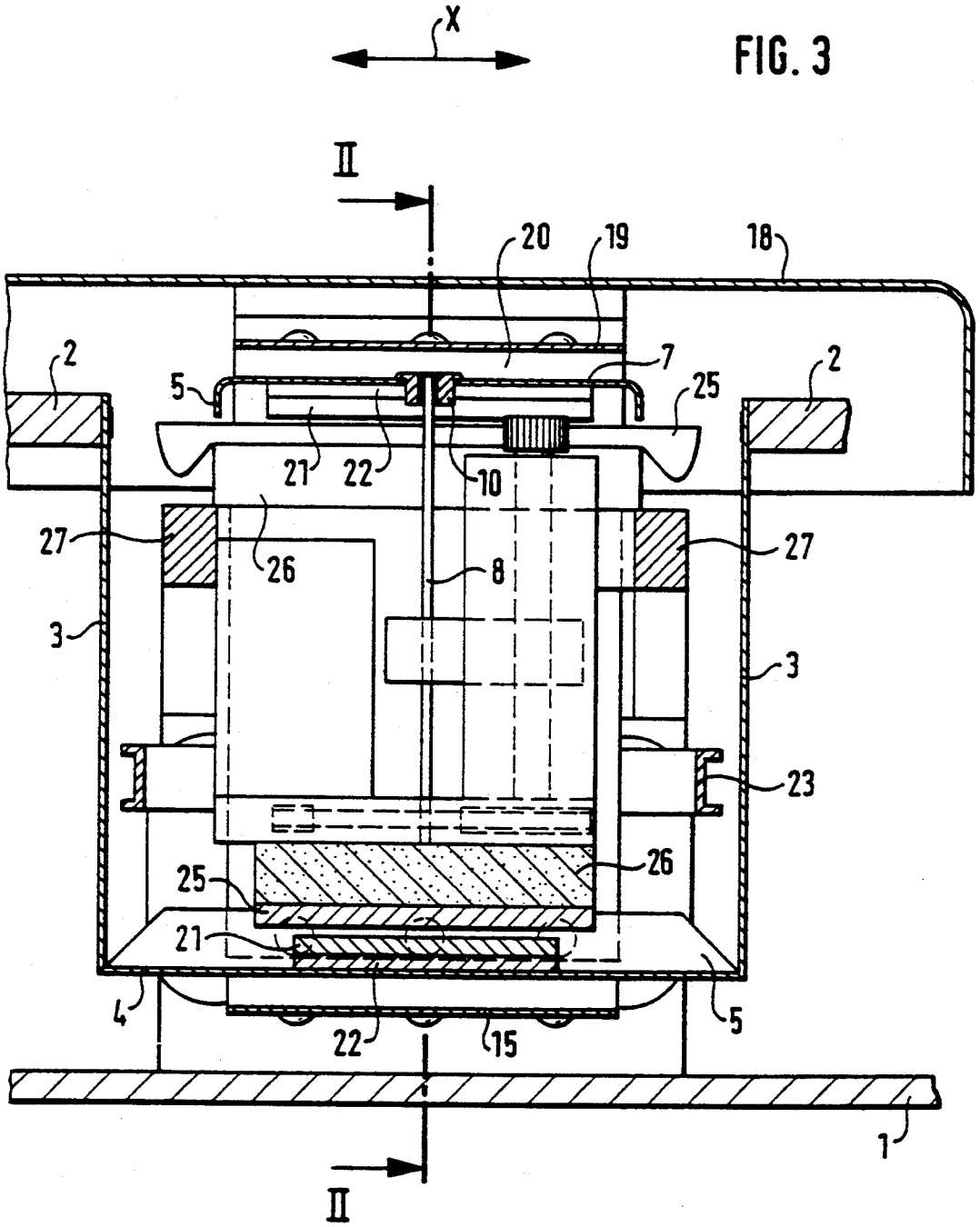
FIG. 3 is a cross sectional view taken generally along the line III—III of FIG. 2 which corresponds to a view along the section line II—II of FIG. 3.

In structural terms, these have been shown in greater detail in FIGS. 2 and 3. In FIG. 1 the permanent magnets have been represented at 41 and 42 affixed to one of the leaf springs 3 and to the Y frame plate respectively and juxtaposed with respective drive coils 43 and 44. The coils 43 and 44 are energized by variable frequency sources 45 and 46, respectively, permitting the oscillation frequencies to the two frames to be separately selected and to be different from one another.

Each of the sources is in circuit with a respective attentuator 47, 48, represented by a variable resistance so that the amplitude of the oscillations applied to the X frame and the Y frame can be adjusted independently of one another.

In addition, each of the circuits includes a phase shifter, here represented by variable capacitors 50 and 51 which can be adjusted independently of one another to shift the phase of the respective oscillations applied to the X and Y frames independently of one another.

Each of the drive systems may have a pickup coil 52, 53 for detecting the oscillation parameters of the respective frame, i.e. the X frame and the Y frame, feeding a comparator which is in the form of a microcomputer 54 so that an error signal can be generated and transmitted, e.g. by a feedback loop 55, to control one or more of the circuit components, such as the oscillator 45 or 46, the attenuator 47, 48 or the phase shifter 50, 51 so that the preselected oscillation parameters correspond thereto, set by the computer 54, is maintained. The parameters can be displayed at a monitor 56 connected to the computer 54.

It will thus be apparent that with the aid of the oscillating drive 41, 43, 45, 47, 50 coupled to the X frame, the X frame will be set in oscillation in the X direction and will entrain in a corresponding oscillatory movement all of the components attached thereto including the Y frame and the object carrier. Simultaneously the oscillating drive 42, 44, 46, 48, 51 operatively coupled with the Y frame will set into oscillatory movement in the Y direction the Y frame and all the parts connected therewith including the object carrier, thereby imparting at least two dimensional oscillations to the object carrier.

In FIG. 1 I have also shown in broken lines a device for two dimensional alterations of the spring constants of the X spring 3 and the Y springs 6. This device comprises a spring rod 8 whose lower end is engaged in a flange 9 disposed in and fixed on the base plate 1, clamped in the X frame plate 4 and having its upper end received in a journal bearing 10 of the Y frame plate 7. The lower end of the rod 8 is surrounded by a threaded sleeve 11 upon which an adjustable nut 12 is received. The nut 12 passes the rod 8 with slight play at its passage 13. The nut 12 is a weight adjustable along the rod 8. During operation, the spring constant of the rod 8 adds to the spring constants of the X springs and the Y springs 4. The total spring constants for the X direction and the Y direction can be changed by adjusting the position of the weight 12 along the sleeve 11 to shift the resistance point of the oscillatory system.

The mixer shown in FIGS. 2 and 3, in which reference numerals correspond to those of FIG. 1 represent similarly functioning parts, is designed for three dimensional oscillatory movements. The X frame plate 4 of the X frame is centrally connected by a spacer bar 14 on a leaf spring 15 which here constitutes the Z spring, being deflectable in a direction perpendicular to the X direction and to the Y direction, namely in the Z direction.

The ends of the Z spring 15 extend into generally vertical spring plates or leaf springs 16 which are deflectable in the Y direction and terminate at their upper ends in hinges 17 whose hinge axes extend in the X direction.

The hinges 17 are connected to the underside of an object carrier 18, i.e. a table or platform upon which a vessel containing the substance to be mixed can be set. The hinges 17 carry a spring plate 19 also deflectable in the Z direction and connected by a spacer bar 20 extending in the X direction with the upper side of the Y frame plate 7.

Each of the oscillating drives for the respective direction of oscillation X, Y, Z of a Cartesian coordinate system, comprises a respective permanent magnet device 21 which is connected by a highly magnetically-permeable flux closure plate 22 to the upper side of the X frame plate 4 or the lower side of the Y frame plate 7 or the outer side of ribs 24 connecting the Z frame 23 to the Z spring 15.

Each of the permanent magnets 21 is juxtaposed with a drive coil 25 shown schematically as a plate in FIGS. 2 and 3 and preferably constituted as a flat spiral winding. Each of the windings 25 is mounted on an electrically nonconducting highly magnetically permeable flux closure plate 26 of a respective stator carrier 27.

In operation, of course, the drives can be provided with oscillators and parameter-controlling components in the manner described in connection with FIGS. 1 to set any vessel on the object carrier into three dimensional oscillatory movements, i.e. a compound oscillation with components in the X, Y, and Z directions. Each of the oscillatory units of the embodiment of FIGS. 2 and 3 can include a device for altering the respective spring constant.

In FIGS. 2 and 3 I have shown a device for altering the spring constants in the Y direction. This device includes a housing 28 connected with the X frame plate and provided at its lower end with a lateral flange 29 in which the spring rod 8 is engaged. The upper end of the spring rod 8 is received in a journal bearing 10 of the Y frame plate 7. In the housing 28, moreover, a spindle 30 is journaled for rotation by a knob 31. On the spindle 30 a spindle nut 32 is guided for vertical movement and carries a fork 34 which projects through a window 33 in the housing and engages the rod 8 in the fork slit between the arms of the fork.

Figure 5:
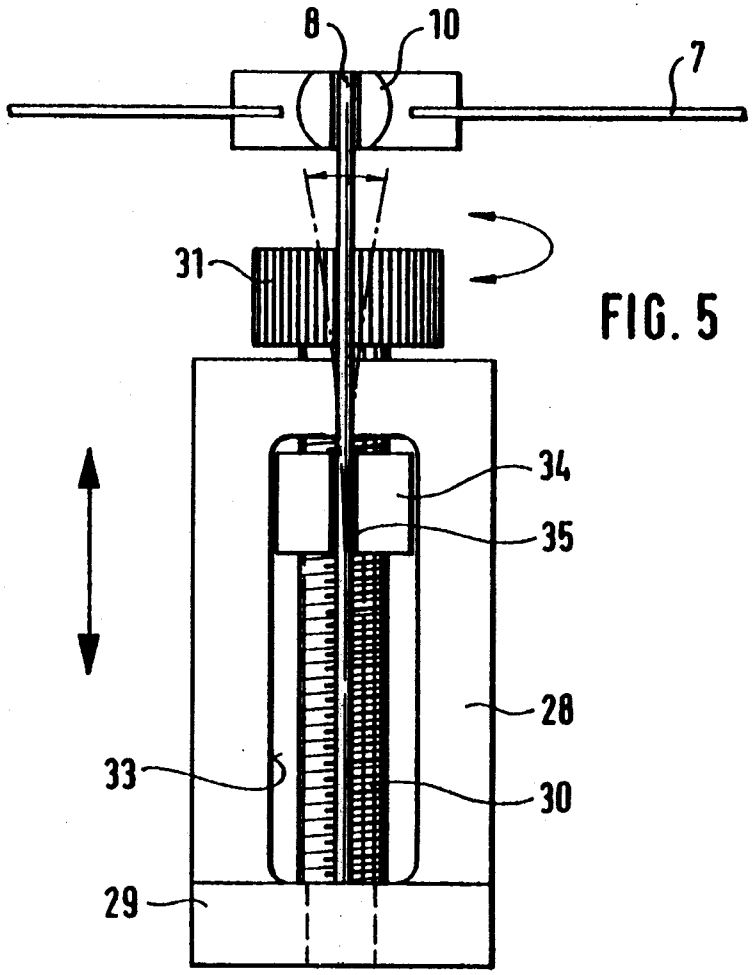
FIG. 5 is a view of the device of FIG. 4 in another projection.

As has already been indicated with respect to FIG. 5, the spring constants of the rod 8 add to the spring constant of the Y spring and the total spring constant can be adjusted by varying the position of the fork 34 and the vibratile movement permitted for the rod 8 by the position of the fork.

In the embodiment of FIGS. 2 and 3, the spring constants in the Z direction can also be altered. For that reference may be had to FIGS. 4 and 5 where the device for altering the spring constants is shown but which would require rotating the device into a horizontal orientation so that the housing 28 and the rod 8 are both rotated through 90° to the plane of FIGS. 4 and 5. In that case the free end of the rod 8 would engage in a bearing 10 of the frame member 24.

Figure 4:
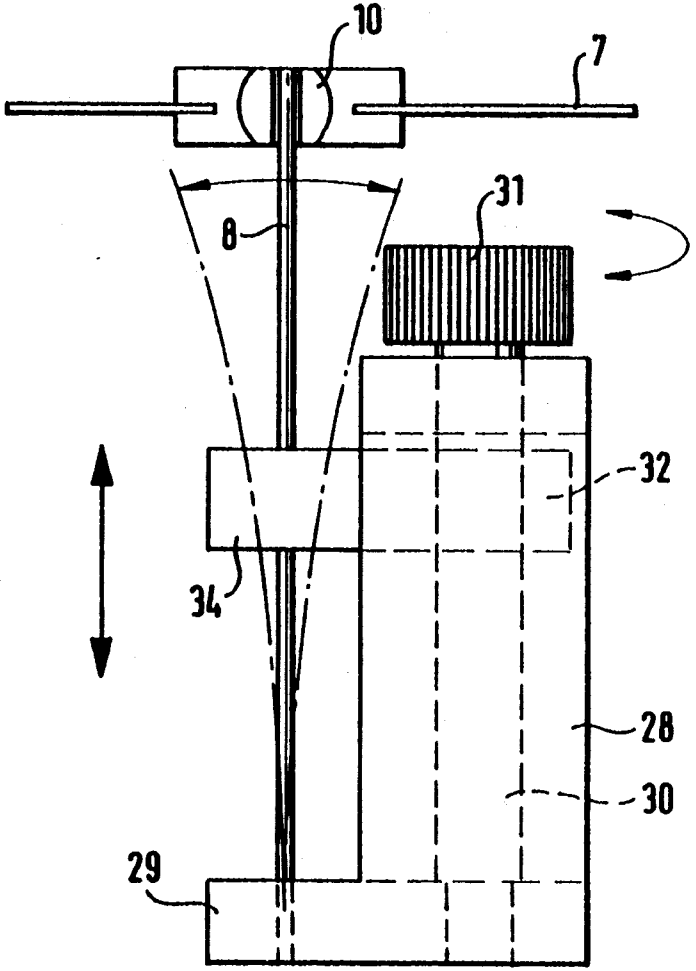
FIG. 4 is a diagrammatic side view of a device for monodimensional modification of the spring constant of a spring bar, rod or leaf spring.

In other words, a device similar to that shown in FIGS. 4 and 5 can be provided to control the spring movements in the horizontal plane and, if rotated through 90° in the vertical plane as well. Not shown in FIGS. 2 and 3 are the means for controlling the oscillating drives independently of one another in accordance with frequency, amplitude and phase, the feedback frame for such control and the means for monitoring the operating parameters of the individual oscillating drive as a function of time, all of which have been described in connection with FIG. 1 and may be used here as well.

The mixer of the invention enables a contactless controllable and adjustable energy input into liquid, viscous, pasty and granular media and can be used for dispersion, mixing, sedimentation and material separation.

I claim:

1. A mixer for multidimensional oscillation of an object, comprising:

a first generally horizontal frame movable in a Y-axis direction and carrying said object;

first spring means including at least one spring deflectable in said Y-axis direction for supporting said first frame for oscillation in said Y-axis direction;

a second generally horizontal frame movable in a X-axis direction supporting said first spring means and the first frame thereon;

second spring means including at least one spring deflectable in said X-axis direction for supporting said second frame for oscillation in said X-axis direction;

a base plate supporting said second spring means; and respective oscillating drives for said frames each including a permanent magnet and a drive coil juxtaposed with the respective permanent magnet and operatively connected to said frames for oscillatingly driving said first frame in said Y-axis direction and said second frame in said X-axis direction.

2. The mixer for multidimensional oscillation defined in claim 1 wherein said springs of said first and second spring means are leaf springs.

3. The mixer for multidimensional oscillation defined in claim 1 wherein each of said frames is generally rectangular and is supported by two leaf springs along opposite edges of the frame.

4. The mixer for multidimensional oscillation defined in claim 1, further comprising at least one spring displaceable in a Z-axis direction, supporting said second frame and provided with at least one Z-axis oscillating drive.

5. The mixer for multidimensional oscillation defined in claim 1 wherein said carrier is connected by hinges extending parallel to the X-axis to a spring plate delectable in the Z-axis direction on said first frame.

6. The mixer for multidimensional oscillation defined in claim 1, further comprising a device for two-dimensional adjustment of spring constants of the mixer connected to one of said frames and including a spring bar secured at one end to said one of said frames and a weight adjustably positionable along said spring bar.

7. The mixer for multidimensional oscillation defined in claim 1, further comprising a device for one-dimensional adjustment of a spring constant of one of said frames and including and elongated spring extending from said one of said frames, a fork displaceable parallel to said elongated spring and engageable therewith at variable locations along said elongated spring, and a spindle drive parallel to said elongated spring for displacing said fork.

8. The mixer for multidimensional oscillation defined in claim 7 wherein said elongated spring is a spring rod secured at one end to said one of said frames.

9. The mixer for multidimensional oscillation defined in claim 7 wherein said elongated spring is a leaf spring.

10. The mixer for multidimensional oscillation defined in claim 7 wherein said elongated spring is a spring of said second spring means and said one of said frames is said second frame.

11. The mixer for multidimensional oscillation defined in claim 1, further comprising a device for adjusting a spring constant of the mixer, comprising a spring rod journaled in said first frame and extending between said frames and said base plate.

12. The mixer for multidimensional oscillation defined in claim 1 wherein a frame displaceable in a Z-axis direction is provided and has a spring and a device for adjusting a spring constant thereof, said device including a horizontally extending spring rod journaled in said frame displaceable in a Z-axis direction and engaging said base plate or a part connected therewith.

13. The mixer for multidimensional oscillation defined in claim 1, further comprising means for independently controlling frequency, amplitude and phase of said oscillating drives.

14. The mixer for multidimensional oscillation defined in claim 1, further comprising means for monitoring operating parameters of the respective oscillating drives as a function of time.

* * * * *